US007467595B1

(12) United States Patent
Lanyi et al.

(10) Patent No.: US 7,467,595 B1
(45) Date of Patent: Dec. 23, 2008

(54) JOYSTICK METHOD FOR MANEUVERING A MARINE VESSEL WITH TWO OR MORE STERNDRIVE UNITS

(75) Inventors: William D. Lanyi, Malone, WI (US); Richard A. Davis, Mequon, WI (US)

(73) Assignee: Brunswick Corporation, Lake Forest, IL (US)

( * ) Notice: Subject to any disclaimer, the term of this patent is extended or adjusted under 35 U.S.C. 154(b) by 56 days.

(21) Appl. No.: 11/654,138

(22) Filed: Jan. 17, 2007

(51) Int. Cl.
*B63H 25/00* (2006.01)

(52) U.S. Cl. ..... 114/144 R; 440/53

(58) Field of Classification Search ..... 114/144 A, 114/144 R, 145 R; 440/1, 53, 58, 60, 84
See application file for complete search history.

(56) References Cited

U.S. PATENT DOCUMENTS

| | | | | |
|---|---|---|---|---|
| 3,521,589 | A | 7/1970 | Kemp | 114/16 |
| 4,220,111 | A | 9/1980 | Krautkremer et al. | 440/53 |
| 4,691,659 | A | 9/1987 | Ito et al. | 114/144 R |
| 4,947,782 | A | 8/1990 | Takahashi | 114/312 |
| 5,090,929 | A | 2/1992 | Rieben | 440/40 |
| 5,924,379 | A | 7/1999 | Masini et al. | 114/150 |
| 6,142,841 | A | 11/2000 | Alexander, Jr. et al. | 440/38 |
| 6,234,853 | B1 | 5/2001 | Lanyi et al. | 440/53 |
| 6,276,977 | B1 | 8/2001 | Treinen et al. | 440/61 |
| 6,406,340 | B1 | 6/2002 | Fetchko et al. | 440/61 |
| 6,447,349 | B1 | 9/2002 | Fadeley et al. | 440/41 |
| 6,684,803 | B1 | 2/2004 | Dickson | 114/144 R |
| 6,755,703 | B1 | 6/2004 | Erickson | 440/75 |
| 6,896,563 | B1 | 5/2005 | Dickson | 440/40 |
| 6,994,046 | B2 | 2/2006 | Kaji et al. | 114/144 R |
| RE39,032 | E | 3/2006 | Gonring et al. | 440/87 |
| 7,131,385 | B1 * | 11/2006 | Ehlers et al. | 114/145 R |
| 7,267,068 | B2 * | 9/2007 | Bradley et al. | 114/144 R |
| 7,305,928 | B2 * | 12/2007 | Bradley et al. | 114/144 R |
| 2005/0263058 | A1 * | 12/2005 | Suemori et al. | 114/144 R |

* cited by examiner

*Primary Examiner*—Lars A Olson
(74) *Attorney, Agent, or Firm*—William D. Lanyi

(57) ABSTRACT

A method for controlling the movement of a marine vessel rotates one of a pair of marine propulsion devices and controls the thrust magnitudes of two marine propulsion devices. A joystick is provided to allow the operator of the marine vessel to select port-starboard, forward-reverse, and rotational direction commands that are interpreted by a controller which then changes the angular position of at least one of a pair of marine propulsion devices relative to its steering axis.

19 Claims, 8 Drawing Sheets

THRUST VECTOR TABLE

| EXAMPLE | JOYSTICK X | JOYSTICK Y | JOYSTICK M | THRUST PORT | THRUST STRBD | THETA (DEGREES) |
|---|---|---|---|---|---|---|
| 1 | 10.0 | 10.0 | 10.0 | 41.667 | -33.208 | -17.526 |
| 2 | 10.0 | 10.0 | 0.0 | 38.333 | -30.046 | -19.440 |
| 3 | 10.0 | 10.0 | -10.0 | 35.000 | -26.926 | -21.801 |
| 4 | 10.0 | 0.0 | 10.0 | 36.667 | -38.006 | -15.255 |
| 5 | 10.0 | 0.0 | 0.0 | 33.333 | -34.801 | -16.699 |
| 6 | 10.0 | 0.0 | -10.0 | 30.000 | -31.623 | -18.435 |
| 7 | 10.0 | -10.0 | 10.0 | 31.667 | -42.850 | -13.496 |
| 8 | 10.0 | -10.0 | 0.0 | 28.333 | -39.616 | -14.621 |
| 9 | 10.0 | -10.0 | -10.0 | 25.000 | -36.401 | -15.945 |
| 10 | 0.0 | 10.0 | 10.0 | 8.333 | 1.667 | 0.000 |
| 11 | 0.0 | 10.0 | 0.0 | 5.000 | 5.000 | 0.000 |
| 12 | 0.0 | 10.0 | -10.0 | 1.667 | 8.333 | 0.000 |
| 13 | 0.0 | 0.0 | 10.0 | 3.333 | -3.333 | 0.000 |
| 14 | 0.0 | 0.0 | 0.0 | 0.000 | 0.000 | 0.000 |
| 15 | 0.0 | 0.0 | -10.0 | -3.333 | 3.333 | 0.000 |
| 16 | 0.0 | -10.0 | 10.0 | -1.667 | -8.333 | 0.000 |
| 17 | 0.0 | -10.0 | 0.0 | -5.000 | -5.000 | 0.000 |
| 18 | 0.0 | -10.0 | -10.0 | -8.333 | -1.667 | 0.000 |
| 19 | -10.0 | 10.0 | 10.0 | -25.000 | 36.401 | -15.945 |
| 20 | -10.0 | 10.0 | 0.0 | -28.333 | 39.616 | -14.621 |
| 21 | -10.0 | 10.0 | -10.0 | -31.667 | 42.850 | -13.496 |
| 22 | -10.0 | 0.0 | 10.0 | -30.000 | 31.623 | -18.435 |
| 23 | -10.0 | 0.0 | 0.0 | -33.333 | 34.801 | -16.699 |
| 24 | -10.0 | 0.0 | -10.0 | -36.667 | 38.006 | -15.255 |
| 25 | -10.0 | -10.0 | 10.0 | -35.000 | 26.926 | -21.801 |
| 26 | -10.0 | -10.0 | 0.0 | -38.333 | 30.046 | -19.440 |
| 27 | -10.0 | -10.0 | -10.0 | -41.667 | 33.208 | -17.526 |

*FIG. 10*

JOYSTICK METHOD FOR MANEUVERING A MARINE VESSEL WITH TWO OR MORE STERNDRIVE UNITS

BACKGROUND OF THE INVENTION

1. Field of the Invention

The present invention is generally related to a maneuvering system for a marine vessel and, more particularly, to a system by which a marine vessel can be maneuvered through the use of a joystick and two or more independently steerable marine propulsion devices.

2. Description of the Related Art

Many different systems are known to those skilled in the art of marine vessel design for steering a marine vessel. In addition, numerous techniques have been developed by which an operator of a marine vessel can use a joystick to command various movements of the marine vessel. Many of these systems utilize two or more independently steerable marine propulsion devices that are manipulated in order to result in a desired movement of the marine vessel. These systems are particularly useful in docking a pleasure craft. Some of these maneuvering systems incorporate a bow thruster in combination with other propulsion devices, such as sterndrive units or outboard motors. However, some marine propulsion systems have been developed which provide adequate maneuvering of the marine vessel through the use of two independently steerable marine propulsion devices without the need for a bow thruster.

U.S. Pat. No. 3,521,589, which issued to Kemp on Jul. 21, 1970, describes an underwater vessel that comprises a shell having a pair of propelling and maneuvering devices mounted on opposite sides thereof. Each of the propelling devices includes a transversely extending hollow gooseneck, having an arm-receiving opening in one side thereof. An L-shaped arm assembly includes a hollow base portion extending coaxially through the gooseneck and a hollow secondary portion extending transversely of the base portion, geared thereto, and projecting through the arm-receiving opening.

U.S. Pat. No. 4,220,111, which issued to Krautkremer et al. on Sep. 2, 1980, describes a drive and control device for a watercraft having at least one pair of steerable propellers. The pair of steerable propellers is spaced longitudinally along the center of the watercraft from a center of lateral resistance on the watercraft. The steerable propellers are also spaced equidistant from the longitudinal centerline and on opposite sides thereof.

U.S. Pat. No. 4,691,659, which issued to Ito et al. on Sep. 8, 1987, describes an apparatus for steering joystick of ship. The rotation angles around the X and Y axes due to the operation of a joystick lever having degrees of freedom of three axes are respectively detected by two rotation angle detectors. A push button switch is provided at the edge of the joystick lever. When the push button switch is not operated, the operating direction and operation amount of the joystick lever are calculated on the basis of the outputs of two rotation angle detectors. When the push button switch was operated, the operating direction and operation amount of the joystick lever are calculated from the output of either one of two rotation angle detectors.

U.S. Pat. No. 4,947,782, which issued to Takahashi on Aug. 14, 1990, describes a remotely operated vehicle. The vehicle is provided with not less than three thrusters arranged in the longitudinal direction of a vehicle body. The center of gravity of the vehicle body includes a pendulum and the center of buoyancy of the vehicle body including the pendulum are set in agreement with each other and the pendulum is provided so that it can be turned around a Y-axis extending in the lateral direction of the vehicle body and passing the center of gravity thereof.

U.S. Pat. No. 5,090,929, which issued to Rieben on Feb. 25, 1992, describes a paired motor system for a small boat propulsion and steerage. The motors provide a steerable propelling system for small boats. Each motor drives a propeller carried in an elongate channel communicating with each lateral side of a boat beneath the water line to one boat end to move water through the channels for boat propulsion. The electric motors are of variable speed, reversible and separately controlled by a joystick-type control device to provide differential control of motor speed to allow steerage.

U.S. Pat. No. 5,924,379, which issued to Masini et al. on Jul. 20, 1999, discloses an actuating mechanism with an improved mounting structure. The mechanism is provided with supported members that extend away from the centerline of a cylinder bore, piston and actuator rod of an actuation mechanism that uses pressure to move the piston within a cylinder bore. Two support members are attached to a cylinder housing and provided with mounting holes. The two support members are spaced apart from the cylinder housing to allow external support structure to be placed between the cylinder housing and the two support members. Appropriate fasteners, such as bolts, attach each of the two support members to the external support structure in such a way that the cylinder housing can pivot about an axis extending through both bolts. Most importantly, a line extending through the supporting bolts intersect the cylinder bore at a place between its opposing ends. This reduces the required space necessary to allow the cylinder to pivot properly.

U.S. Pat. No. 6,142,841, which issued to Alexander et al. on Nov. 7, 2000, discloses a waterjet docking control system for a marine vessel. The maneuvering control system utilizes pressurized liquid at three or more positions on a marine vessel in order to selectively create thrust that moves the marine vessel into desired locations and according to chosen movements. A source of pressurized liquid, such as a pump or a jet pump propulsion system, is connected to a plurality of distribution conduits which, in turn, are connected to a plurality of outlet conduits. In any of the embodiments of the invention, a joystick control can be used to select or deselect each of the outlet conduits and, in certain embodiments, to select the direction of operation of an associated reversible motor.

U.S. Pat. No. 6,234,853, which issued to Lanyi et al. on May 22, 2001, discloses a simplified docking method and apparatus for a multiple engine marine vessel. A docking system is provided which utilizes the marine propulsion unit of a marine vessel, under the control of an engine control unit that receives command signals from a joystick or pushbutton device, to respond to a maneuver command from the marine operator. The docking system does not require additional propulsion devices other than those normally used to operate the marine vessel under normal conditions. The docking or maneuvering system of the invention uses two marine propulsion units to respond to an operator's command signal and allows the operator to select forward or reverse commands in combination with clockwise or counterclockwise rotational commands either in combination with each other or alone.

U.S. Pat. No. 6,276,977, which issued to Treinen et al. on Aug. 21, 2001, discloses an integrated hydraulic steering actuator. The actuator is provided for an outboard motor system in which the cylinder and piston of the actuator are disposed within a cylindrical cavity inside a cylindrical portion of a swivel bracket. The piston within the cylinder of the actuator is attached to at least one rod that extends through clearance holes of a clamp bracket and is connected to a steering arm of an outboard motor.

U.S. Pat. No. 6,406,340, which issued to Fetchko et al. on Jun. 18, 2002, describes a twin outboard motor hydraulic steering system. The steering assembly applies a force to the tiller arms of twin marine, outboard propulsion units and rotates the propulsion units about a steering axis between a center position and hard over positions to each side of the center position. A tie bar is pivotally connected to the steering apparatus and pivotally connected to the tiller arm of a second propulsion unit.

U.S. Pat. No. 6,447,349, which issued to Fadeley et al. on Sep. 10, 2002, describes a stick control system for watercraft boats. The boat has a reversing bucket for controlling forward/reverse thrust and a rotatable nozzle for controlling sideward forces. A bucket position sensor is connected to the reversing bucket, and the bucket is controlled using the output of the position sensor to enable the bucket to automatically moved to a neutral thrust position.

U.S. Pat. No. 6,684,803, which issued to Dickson on Feb. 3, 2004, describes a watercraft steering apparatus with a joystick. The apparatus includes a movable two directional joystick including a steering arm, a depressible throttle trigger affixed to an upper end portion of the joystick, and a pulley system including a steering cable attached to a lower end of the steering arm, the steering cable extending around pulleys affixed to the starboard or port side of the watercraft in matching pairs.

U.S. Pat. No. 6,755,703, which issued to Erickson on Jun. 29, 2004, discloses a hydraulically assisted gear shift mechanism for a marine propulsion device. The mechanism is for use in conjunction with a gear shift device and provides a hydraulic cylinder and piston combination connected by a linkage to a gear shift mechanism. Hydraulic pressure can be provided by a pump used in association with either a power trim system or a power steering system. Hydraulic valves are used to pressure selected regions of the hydraulic cylinder in order to actuate a piston which is connected, by an actuator, to the gear shift mechanism.

U.S. Pat. No. 6,896,563, which issued to Dickson on May 24, 2005, describes a joystick steering apparatus for a watercraft. The apparatus includes a joystick comprising at least three movable interconnected swinging arms with a first and third one of the swinging arms being generally vertically oriented and a second one of the swinging arms being generally horizontally oriented. It also includes a mechanical housing supporting the joystick and at least one mechanism movably connecting the joystick apparatus to an outdrive of the watercraft.

U.S. Pat. No. 6,994,046, which issued to Kaji et al. on Feb. 7, 2006, describes a marine vessel running controlling apparatus. The apparatus controls running of a marine vessel and includes a pair of propulsion systems which respectively generate propulsive forces on a rear port side and a rear starboard side of the hull and a pair of steering mechanisms which respectively change steering angles defined by directions of the propulsive forces with respect to the hull. The apparatus includes a target combined propulsive force acquiring section, a target movement angle acquiring section, a steering controlling section which controls the steering angles of the respective steering mechanisms such that a turning angular speed of the hull is substantially equal to a predetermined target angular speed, a target propulsive force calculating section which calculates target propulsive forces to be generated from the respective propulsion systems based on the target combined propulsive force, the target movement angle and the steering angles of the respective steering mechanisms, and a propulsive force controlling section which controls the respective propulsion systems so as to attain the target propulsive forces.

U.S. Pat. RE39,032, which issued to Gonring et al. on Mar. 21, 2006, discloses a multi-purpose control mechanism for a marine vessel. The mechanism allows the operator of a marine vessel to use the mechanism as both a standard throttle and a gear selection device and, alternatively, as a multi-axes joystick command device. The control mechanism comprises a base portion and a lever that is movable relative to the base portion along with a distal member that is attached to the lever for rotation about a central axis of the lever. A primary control signal is provided by the multi-purpose control mechanism when the marine vessel is operated in a first mode in which the control signal provides information relating to engine speed and gear selection. The mechanism can also operate in a second or docking mode and provide first, second and third secondary control signals relating to desired maneuvers of the marine vessel.

U.S. patent application Ser. No. 11/248,482 (M09992), which was filed on Oct. 12, 2005 by Bradley et al., discloses a method for maneuvering a marine vessel in response to a manually operable control device. The marine vessel is maneuvered by independently rotating first and second marine propulsion devices about their respective steering axes in response to commands received from a manually operable control device, such as a joystick. The marine propulsion devices are aligned with their thrust vectors intersecting at a point on a centerline of the marine vessel and, when no rotational movement is commanded, at the center of gravity of the marine vessel. Internal combustion engines are provided to drive the marine propulsion devices. The steering axes of the two marine propulsion devices are generally vertical and parallel to each other. The two steering axes extend through a bottom surface of the hull of the marine vessel.

U.S. patent application Ser. No. 11/248,483 (M09993), which was filed on Oct. 12, 2005 by Bradley et al., discloses a method for positioning a marine vessel. A vessel positioning system maneuvers a marine vessel in such a way that the vessel maintains its global position and heading in accordance with a desired position and heading selected by the operator of the marine vessel. When used in conjunction with a joystick, the operator of the marine vessel can place the system in a station keeping enable mode and the system then maintains the desired position obtained upon the initial change of the joystick from an active mode to an inactive mode. In this way, the operator can selectively maneuver the marine vessel manually and, when the joystick is released, the vessel will maintain the position in which it was at the instant the operator stopped maneuvering it with the joystick.

U.S. patent application Ser. No. 11/365,175 (M09981), which was filed by Griffiths et al. on Mar. 1, 2006, discloses a selectively lockable marine propulsion device. A steering system for a marine vessel is provided with a connecting link attached to first and second marine propulsion devices. The connecting link is selectively disposable in first and second states of operation which either require synchronous rotation of the first and second marine propulsion devices or, alternatively, independent rotation of the two marine propulsion devices. This allows both marine propulsion devices to be operated by a single actuator or, alternatively, independent maneuvering of the two marine propulsion devices during certain types of docking procedures.

The patents described above are hereby expressly incorporated by reference in the description of the present invention.

SUMMARY OF THE INVENTION

A method for controlling the movement of a marine vessel, in accordance with a preferred embodiment of the present invention, comprises the steps of attaching first and second marine propulsion devices to the marine vessel for rotation about first and second steering axes, connecting first and second steering actuators to the first and second marine propulsion devices, respectively, providing first and second manually manipulatable control devices which are configured to receive position-related commands from an operator of the marine vessel, providing a controller connected in signal communication with the first and second manually manipulatable control devices, receiving a set of vessel maneuver commands from the second manually manipulatable control device, calculating first and second thrust magnitudes for the first and second marine propulsion devices, respectively, and an angular position of the second marine propulsion device which will achieve the appropriate maneuver of the marine vessel, causing the first and second marine propulsion devices to generate the first and second thrust magnitudes, and causing the second marine propulsion device to move to the angular position.

In a preferred embodiment of the present invention, it further comprises the step of connecting a third steering actuator to the first and second marine propulsion devices. The third steering actuator is selectively configurable in a first state wherein the first and second marine propulsion devices are rigidly attached together for synchronous rotation about their respective steering axes and a second state wherein the first and second marine propulsion devices are movable relative to each other. In a preferred embodiment of the present invention, it further comprises the step of causing the first marine propulsion device to move to a fixed position during maneuvering steps. The fixed position disposes a propeller shaft of the first marine propulsion device in parallel association with a central axis of the marine vessel extending from a transom to a bow of the marine vessel. This central axis is generally aligned with a keel of the marine vessel.

In a particularly preferred embodiment of the present invention, it further comprises the steps of using first and second steering actuators to respond to the vessel movement commands. The first and second marine propulsion devices are sterndrive units in a preferred embodiment of the present invention and the sterndrive units are attached to a transom of the marine vessel. The second manually manipulatable control device is a joystick in a preferred embodiment of the present invention and the first manually manipulatable control device is a steering wheel. The controller comprises a microprocessor in a preferred embodiment of the present invention and the vessel maneuver commands comprise a left-right command, a forward-reverse command, and a rotate command.

BRIEF DESCRIPTION OF THE DRAWINGS

The present invention will be more fully and completely understood from a reading of the description of the preferred embodiment in conjunction with the drawings, in which:

FIG. 10 is a table showing hypothetical joystick commands and the thrusts and angular positions of marine propulsion devices which achieve those joystick commands.

DESCRIPTION OF THE PREFERRED EMBODIMENT

Figure 1:
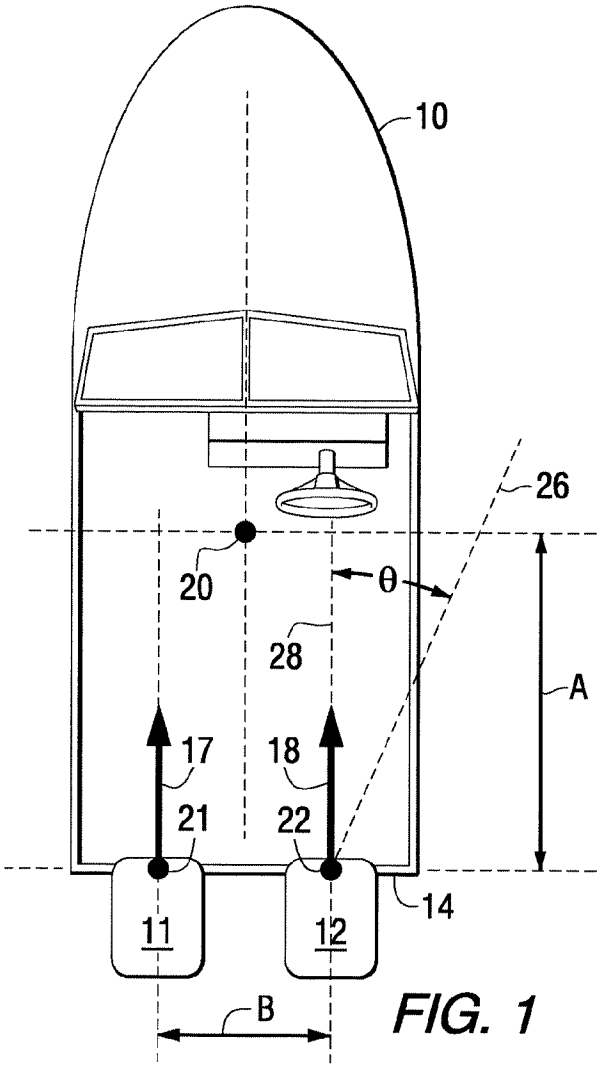
FIGS. 1-4 are schematic illustrations showing various movements of marine propulsion devices relative to a marine vessel.

Throughout the description of the preferred embodiment of the present invention, like components will be identified by like reference numerals.

FIG. 1 is a simplified schematic representation of a marine vessel 10 with a first marine propulsion device 11 and a second marine propulsion device 12 attached to a transom 14 of the marine vessel. Arrows 17 and 18 represent exemplary thrusts provided by the first and second marine propulsion devices. Although both arrows in FIG. 1 illustrate forward thrusts which exert forces on the marine vessel 10 to cause it to move in a forward direction, it should be understood that either one or both of the marine propulsion devices, 11 and 12, can be operated in reverse gear to provide the opposite effect.

Point 20 in FIG. 1 represents an effective center of gravity (i.e. center of turn) for the marine vessel 10. It should be understood that the location of point 20 is not, in all cases, the actual center of gravity of the marine vessel 10. Because of many factors, the effective center of gravity 20 can be at a different location than the actual center of gravity that would be calculated by analyzing the weight distribution of the various components of the marine vessel. In addition, it should be understood that maneuvering a boat 10 in a body of water results in reactive forces exerted against the hull of the boat by the wind and the water. In other words, as various maneuvering thrusts are exerted by the first and second marine propulsion devices, 11 and 12, the hull of the boat pushes against the water in front of it. That water exerts a reaction force against the hull. As a result, the effective center of gravity identified as point 20 in FIG. 1 can change in response to different sets of forces and reactions exerted on the hull of the marine vessel 10. This concept is recognized by those skilled in the art and is referred to as the instantaneous center of turn in U.S. Pat. No. 6,234,853 and as the instantaneous center in U.S. Pat. No. 6,994,046.

With continued reference to FIG. 1, the distance between the instantaneous center of turn, or instantaneous center of gravity 20, and the transom 14 is identified as dimension A and the dimension between the steering axes, 21 and 22, of the first and second marine propulsion devices is identified as dimension B. Both of the marine propulsion devices are rotatable about their individual steering axes, 21 and 22. Dashed line 26 represents a possible range of travel of the thrust 18 of the second marine propulsion device 12 about its steering axis 22. This angle, between dashed line 26 and dashed line 28 is identified as angle θ. In a preferred embodiment of the present invention, both marine propulsion devices are rotatable about their individual steering axes, 21 and 22, in both clockwise and counterclockwise directions.

Figure 2:
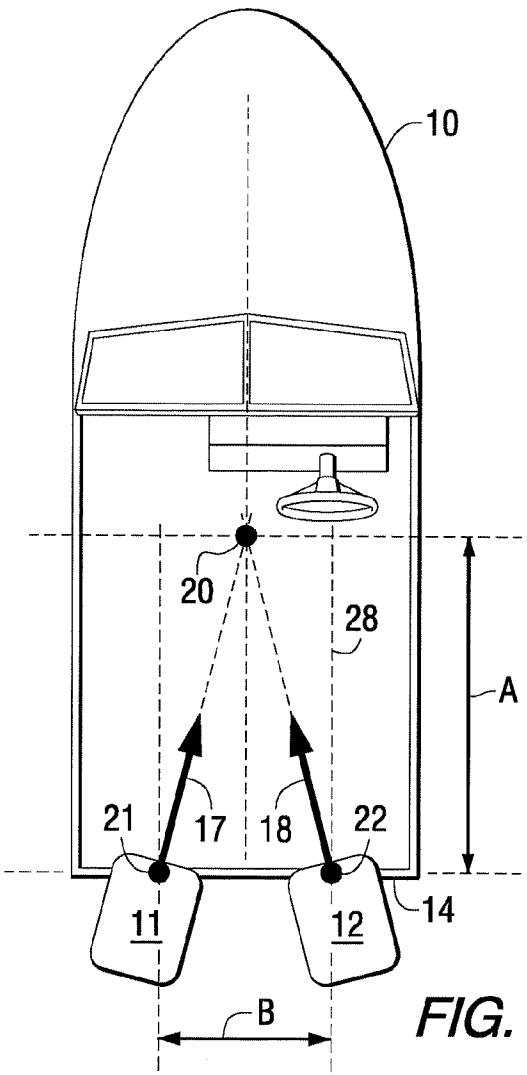

One possible configuration of the marine vessel 10 and its marine propulsion devices, 11 and 12, is shown in FIG. 2. Both thrust vectors, 17 and 18, are directed through the center of gravity 20, or instantaneous center of turn. Under the condition shown in FIG. 2, no effective moment about the center of gravity 20 would exist. As a result, all movement of the marine vessel 10 would occur without rotation of the boat about the center of gravity 20. The various possible maneuvering actions will be described in greater detail below.

Figure 3:
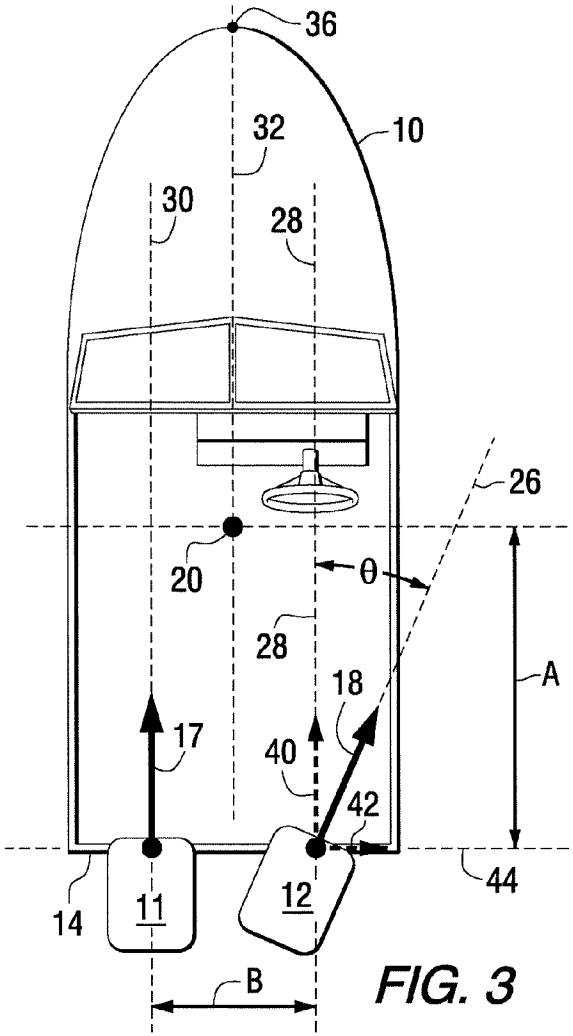

FIG. 3 illustrates the marine vessel 10 with the first marine propulsion device 11 aligned with a line 30 that is generally parallel with a centerline 32 of the marine vessel. The centerline 32 is generally aligned with a keel of the marine vessel that extends from its transom 14 to the bow 36. The second marine propulsion device 12 is turned, at angle θ, so that its thrust vector 18 is aligned with dashed line 26. The thrust vector 18 is resolved in FIG. 3 to a Y axis vector 40 and an X axis vector 42. For purposes of this description, the X axis represents a line 44 that is generally perpendicular to the centerline 32 and exerts a force on the marine vessel 10 in a left or right direction. The Y axis is generally parallel to the centerline 32 and exerts a force on the marine vessel 10 in a forward or reverse direction.

Figure 4:
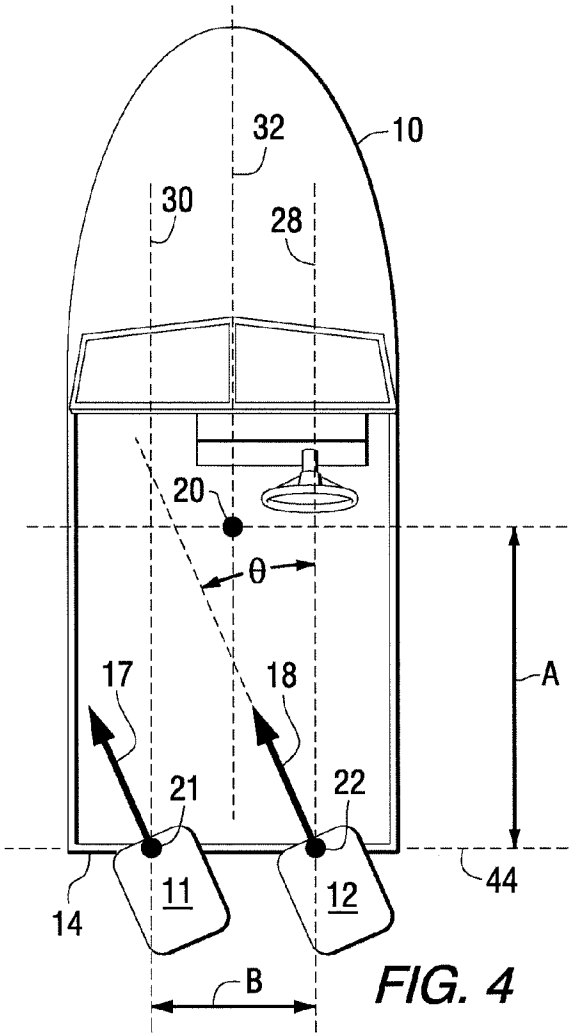

FIG. 4 illustrates the marine vessel 10 with the marine propulsion devices, 11 and 12, rotated about their respective steering axes, 21 and 22, to direct their thrusts, 17 and 18, in a parallel direction to each other. This type of configuration would result when the marine vessel 10 was operated to steer the boat in a convention manner which typically would incorporate a steering wheel. When operating in this way, the thrusts, 17 and 18, of the first and second marine propulsion devices are typically parallel and the marine propulsion devices are typically rotated in synchrony about their respective steering axes, 21 and 22.

With continued reference to FIGS. 1-4, it can be seen that two individually steerable marine propulsion devices allow the operator of a marine vessel a wide variety of maneuvering actions that can be used to cause the boat to move through many different maneuvering and docking motions.

Figure 5C:
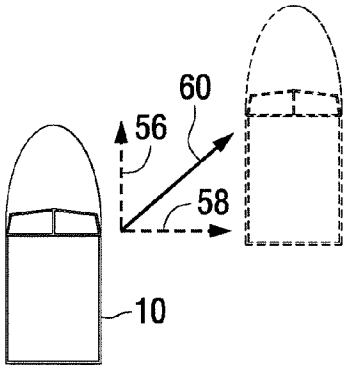
FIGS. 5A-5E show various maneuvering movements of a marine vessel that can be achieved through the use of a preferred embodiment of the present invention.
Figure 5E:
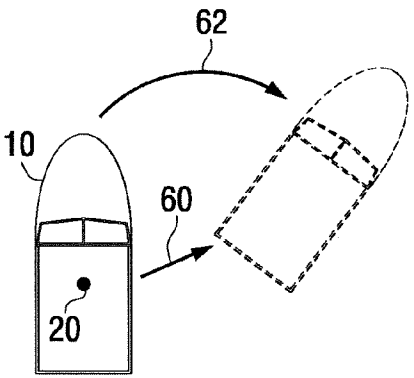
Figure 5B:
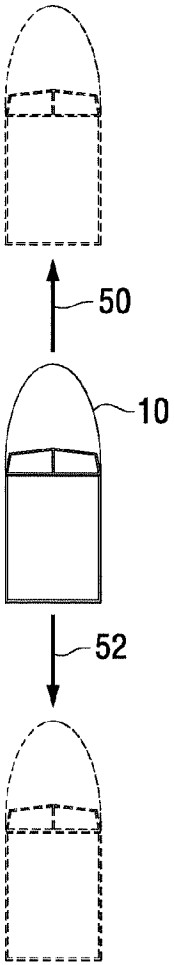
Figure 5A:
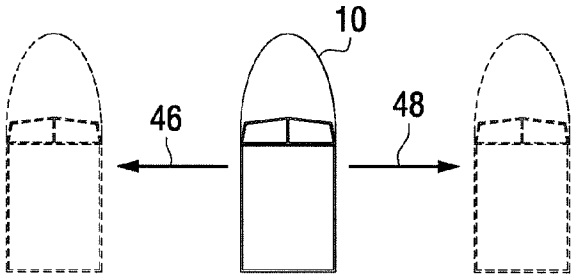
Figure 5D:
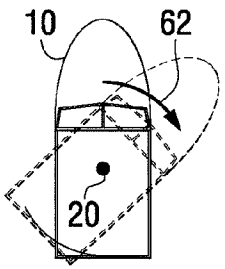

FIGS. 5A-5E are simplified illustrations showing the many different movements that can be accomplished through the use of two individually steerable marine propulsion devices. In FIG. 5A, the boat 10 is shown as being capable of moving to the left 46 and to the right 48 without any forward or reverse motion and without any rotation about its instantaneous center of turn. FIG. 5B, on the other hand, shows the marine vessel 10 moving only forward 50 or backward 52 to the positions identified by dashed line representations of the boat. FIG. 5C shows a combination of forward and starboard motions of the marine vessel 10. The forward movement is represented by dashed arrow 56 and the starboard movement is represented by dashed arrow 58. The resultant vector 60 causes the marine vessel 10 to move toward the position represented by dashed lines in FIG. 5C. FIG. 5D illustrates a rotation 62 of the marine vessel 10 without any movement in a forward, reverse, left, or right direction. The rotation 62 is about the instantaneous center of turn 20. The maneuver represented in FIG. 5D can be particularly advantageous during docking maneuvers. FIG. 5E illustrates a combination of rotation 62 and a translation 60 which is both forward and in the starboard direction. This combination of translation and rotation results in the marine vessel 10 being located in the position represented by dashed lines in FIG. 5E.

With continued reference to FIGS. 5A-5E, it can be seen that many different types of maneuvering motions are possible with two marine propulsion devices that are independently steerable and which can exert both forward and reverse thrusts of selectable magnitude. The concepts described above in conjunction with FIGS. 1-4 and 5A-5E, are also described in U.S. Pat. Nos. 3,521,586 and 4,220,111. In addition, the maneuvering capabilities of such a marine vessel are also described in U.S. Pat. Nos. 6,234,853 and 6,994,046 and in the patent applications filed by Bradley et al. and described above.

Figure 6A:
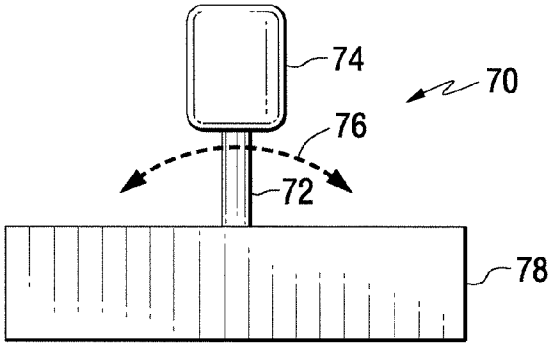
FIGS. 6A-6C illustrate various characteristics of a joystick device.
Figure 6B:
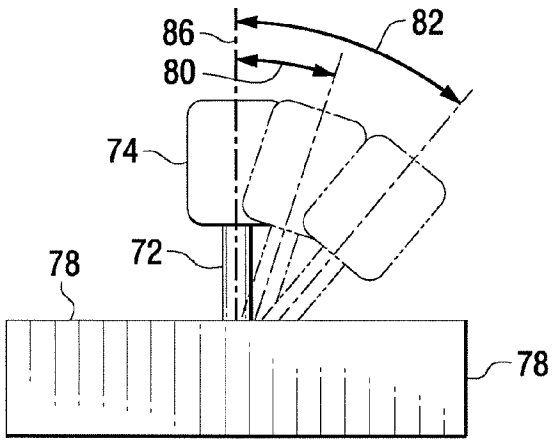
Figure 6C:
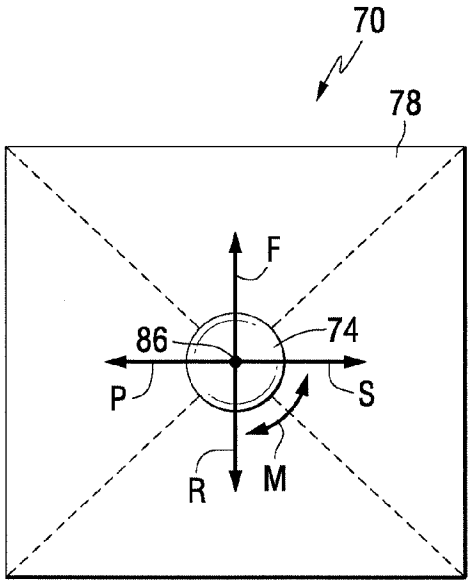

FIG. 6A is a simplified schematic representation of a joystick device 70. It typically comprises a shaft 72 and a handle 74. The shaft 72 is movable, as represented by dashed line arrow 76 in numerous directions relative to the base 78. FIG. 6B illustrates the shaft 72 and handle 74 in three different positions which vary by the magnitude of its angular movement. Arrows 80 and 82 show the different magnitude of movement. In a typical joystick application, the degree of movement away from a generally vertical position, as shown in FIG. 6A, represents the analogous magnitude of an actual movement command selected by an operator. FIG. 6C is a top view of the joystick device 70 in which the handle 74 is in a central, or neutral, position. The handle 74 can be manually manipulated in a forward F, rearward R, port P or starboard S direction. In addition, it can be rotated about the centerline 86 of the rod 72 as represented by arrow M.

With continued reference 6A-6C, a marine vessel operator can manipulate the joystick to provide maneuver commands that will cause the marine vessel to move in a forward-reverse, port-starboard, or rotating movement or any combination of these movements.

It is well known that a marine vessel can be caused to achieve many different types of motions in response to joystick commands provided by the operator of the marine vessel. However, known maneuvering systems cause both of the marine propulsion devices to be steered in cooperation with each other. Typically, this steering is performed in synchrony. In certain situations, it can be beneficial if the maneuvering, such as during docking procedures, can be accomplished without requiring motion of both marine propulsion devices. It is recognized that in certain complex systems, it is possible to logically disconnect a steering wheel (e.g. by interrupting signal communication with the drives) from its associated actuators which are configured to cause rotation of the marine propulsion devices about their respective steering axes. This logical disconnection is preferred during joystick docking maneuvers so that the steering wheel does not continually rotate in response to rotation of the marine propulsion devices about their steering axes. However, in smaller marine vessels with less complicated control systems, it would also be preferred if the steering wheel could be stationary during these joystick docking maneuvers.

An additional consideration, in relation to marine vessels with two or more marine propulsion devices, is the potential loss of hydraulic pressure of one of the two steering systems. In many marine applications, a rigid bar or link is connected between the steering arms of the marine propulsion devices. Naturally, if the marine propulsion devices are to be independently steered, the link must be removable. However, if one of the two hydraulic steering systems experiences a failure, a rigid link can be extremely helpful in allowing the operator of the marine vessel to steer one of the two marine propulsion devices and have the rigid link cause the other marine propulsion device to move in synchrony with the working hydraulic system.

Figure 7:
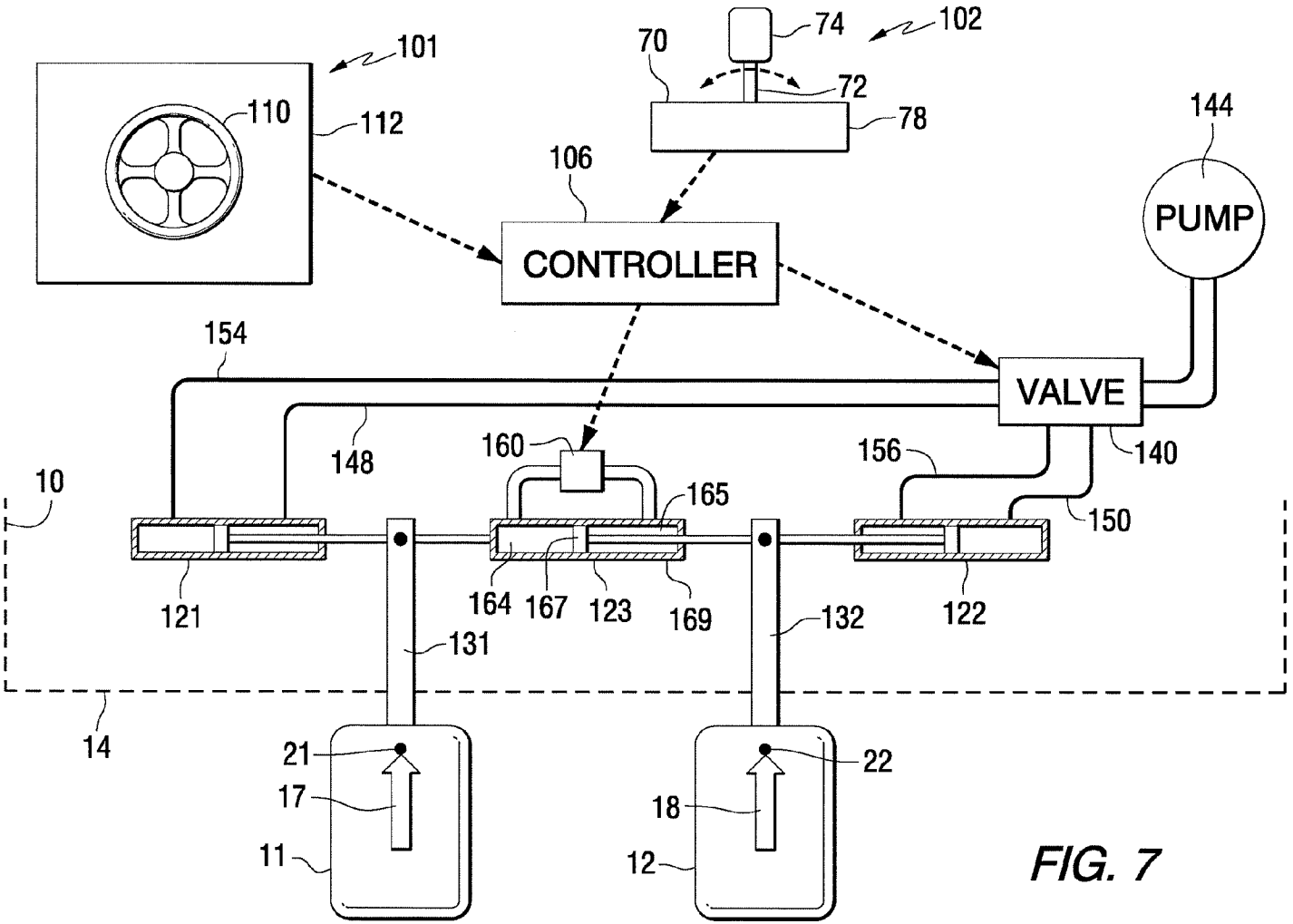
FIGS. 7-9 show various movements of marine propulsion devices in response to activation of steering actuators used in a preferred embodiment of the present invention.

FIG. 7 is a simplified representation of a preferred embodiment of the present invention. The dashed line 10 represents the aft portion of the marine vessel and reference numeral 14 indicates the approximate location of the transom of the marine vessel. First and second manually manipulatable control devices, 101 and 102, are shown connected in signal communication with a controller 106. The first manually manipulatable control device 101 is a steering wheel 110. The steering wheel is shown attached to a console 112. The second manually manipulatable control device 102 is illustrated as the joystick device 70 described above in conjunction with FIGS. 6A-6C.

In a preferred embodiment of the present invention, the steering actuators are hydraulic actuators. However, it should be clearly understood that this is not a requirement in all embodiments. Alternative types of actuators (e.g. electric motors, pneumatic actuators) can be used within the scope of the present invention.

With continued reference to FIG. 7, a first steering actuator 121 and a second steering actuator 122 are shown connected to steering arms, 131 and 132, of the first and second marine propulsion devices, 11 and 12. The first and second steering actuators, 121 and 122, are configured to cause the steering arms, 131 and 132, to rotate about the steering axes, 21 and 22. Actuation of the first and second steering actuators is caused by the valve 140 which is controlled by the controller 106. A hydraulic pump 144 provides pressurized hydraulic fluid which is conducted through the valve 140 in a selective manner in order to actuate the steering actuators. As an example, if the operator of the marine vessel 10 turns the steering wheel 110 in a clockwise rotation to steer the boat toward the right, pressurized hydraulic fluid would be conducted, by the valve, into hydraulic conduits 148 and 150. If, on the other hand, the steering wheel 110 was rotated in a counterclockwise rotation by the operator to cause the boat 10 to turn toward the left, pressurized fluid would be conducted into conduits 154 and 156. Naturally, the valve 140 would conduct the return hydraulic fluid through the other conduits associated with the first and second steering actuators, 121 and 122.

With continued reference to FIG. 7, a third steering actuator 123 is connected to both the first and second steering arms, 131 and 132, and serves to alternately lock the steering arms together or allow them to rotate independently about their respective steering axes, 21 and 22. When valve 160 is closed by the controller 106, hydraulic fluid is not permitted to flow between the chambers identified by reference numerals 164 and 165. Since the hydraulic fluid cannot flow around the piston 167 and through the valve 160, the position of the piston 167 is locked relative to the position of its cylinder 169. Alternatively, by allowing fluid to flow through the valve 160, the controller can unlock the third steering actuator 123 and permit the two marine propulsion devices to rotate about their respective steering axes independent from each other. The result of the changing of the status of valve 160 and the third steering actuator 123 is to change the movement of the first and second marine propulsion devices, 11 and 12, from the synchronous motion described above in conjunction with FIG. 4 and the independent motion described above in conjunction with FIGS. 2 and 3. Throughout the description of the preferred embodiment of the present invention, it should be understood that the physical position of the first and second steering actuators, 121 and 122, relative to the steering arms, 131 and 132, is not limiting to the scope of the present invention. In other words, the first steering actuator 121 could be located to the right of the first steering arm 131 rather than to the left as shown in FIG. 7. Similarly, the steering actuators can be incorporated integrally with transom brackets of the marine propulsion devices. The illustration in FIG. 7 is schematic and intended to show an exemplary functional relationship between the various components.

With continued reference to FIG. 7, it can be seen that the first, second, and third steering actuators can be operated in many different ways. For example, during conventional steering of the marine vessel 10 with the steering wheel 110, valve 160 can be closed so that the third steering actuator 123 acts as a rigid bar or link between the first and second steering arms, 131 and 132. In this state, the first and second steering actuators, 121 and 122, can be operated in synchrony with both of the steering actuators exerting force on their associated steering arms. The third steering actuator 123 would maintain the two steering arms in parallel association with each other so that hydraulic pressure conducted into either of the hydraulic conduits 154 and 156 or into hydraulic conduits 148 and 150 will cause synchronous rotation of the first and second marine propulsion devices, 11 and 12. Alternatively, with the third steering actuator acting as a rigid rod, the valve 140 can allow free flow of hydraulic fluid through conduits 150 and 156 to deactivate the effect of the second steering actuator 122 on the steering effort. As a result, the first steering actuator 121, acting in cooperation with the third steering actuator and closed valve 160, can steer both marine propulsion devices with the piston of the second steering actuator 122 merely moving in response to movement of the second steering arm 132 to which it is connected. Alternatively, the first steering actuator 121 can be deactivated in this way, with the valve 140 allowing a free flow of hydraulic fluid through conduits 148 and 154, and the second steering actuator 122 can cause both marine propulsion devices to rotate about their steering axes. In both of these hypothetical situations, valve 160 is closed by the controller 106 to lock the position of piston 167 relative to cylinder 169. As a result, the third steering actuator 123 acts as a rigid bar between the steering arms 131 and 132.

With continued reference to FIG. 7, it should also be understood that the controller 106 can open valve 160 to allow a free flow of hydraulic fluid between chambers 164 and 165. As a result, piston 167 can move freely within chamber 165 and the two steering arms, 131 and 132, can move independently from each other. This allows the first and second steering actuators, 121 and 122, to control their associated steering arms independently of each other. This type of motion allows the results illustrated in FIGS. 2 and 3. When the operator of the marine vessel is using the joystick 70, the controller 106 would typically open valve 160 to allow independent rotation of the marine propulsion devices, 11 and 12. Alternatively, when the operator of the marine vessel is using the steering wheel 110, the controller 106 would typically close the valve 160 so that the third steering actuator 123 locks the steering arms together and causes the two marine propulsion devices to rotate in synchrony with each other under the control of one or both of the first and second steering actuators, 121 and 122.

Figure 8:
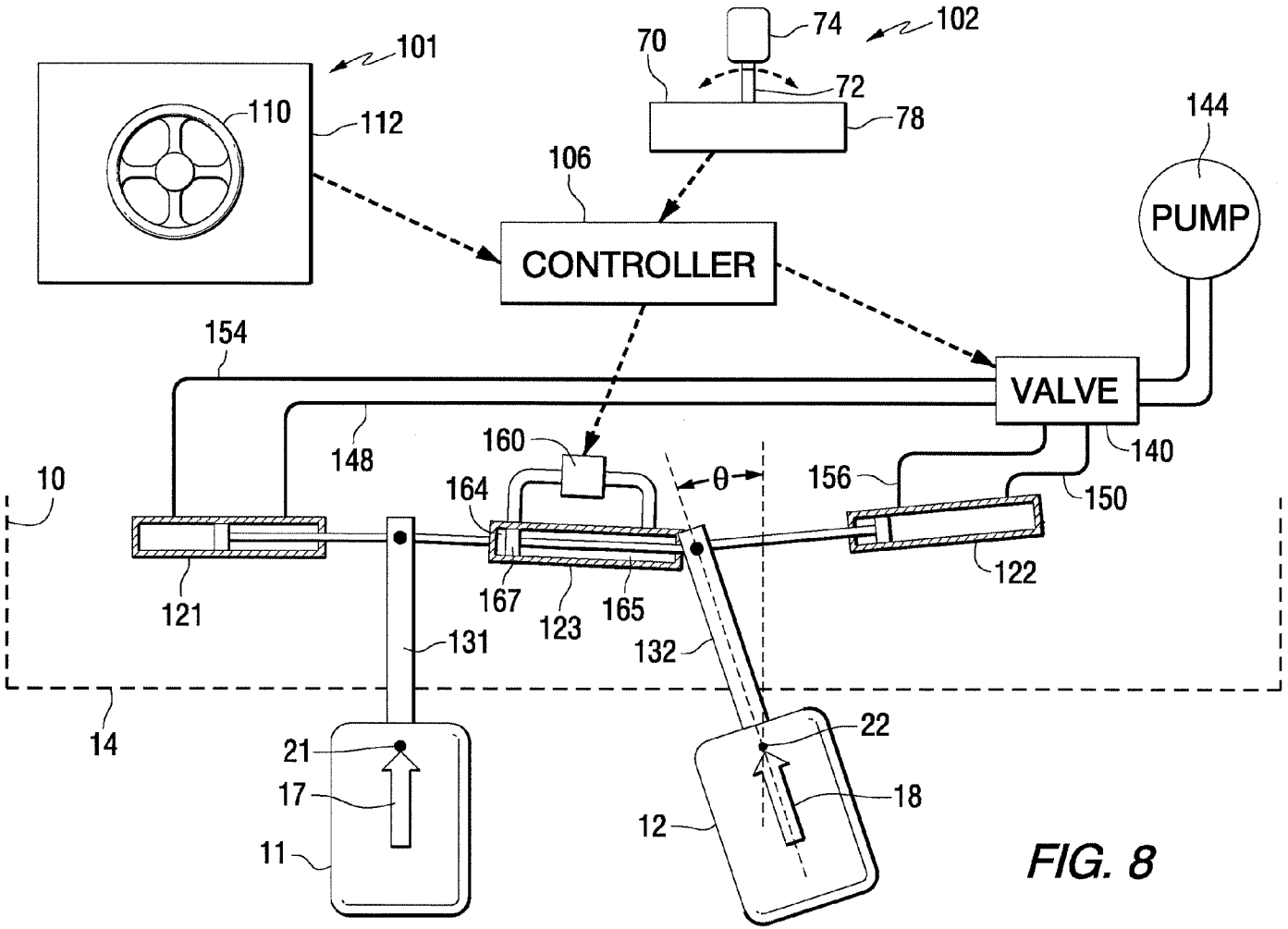

FIG. 8 illustrates the system described above in conjunction with FIG. 7, but with the second marine propulsion device 12 rotated about its steering axis 22 independent of the position of the first marine propulsion device 11. The valve 140, controlled by the controller 106, causes pressurized hydraulic fluid to flow through conduit 150 with returning fluid flowing through conduit 156. Similarly, valve 160 is opened so that hydraulic fluid can flow from chamber 164 to chamber 165. In a preferred embodiment of the present invention, the controller 106 would also cause the valve 140 to prevent fluid flow through conduits 148 and 154. This locks the position of the piston of the first steering actuator 121 in place and prevents rotation of the first marine propulsion device 11 about its steering axis 21. As a result, the operator of the marine vessel is able to use the joystick 70 to maneuver the marine vessel. Also, in this embodiment of the present invention, the first marine propulsion device 11 is locked in a forward position and all maneuvering motions are achieved through the rotation of only the second marine propulsion device 12.

Figure 9:
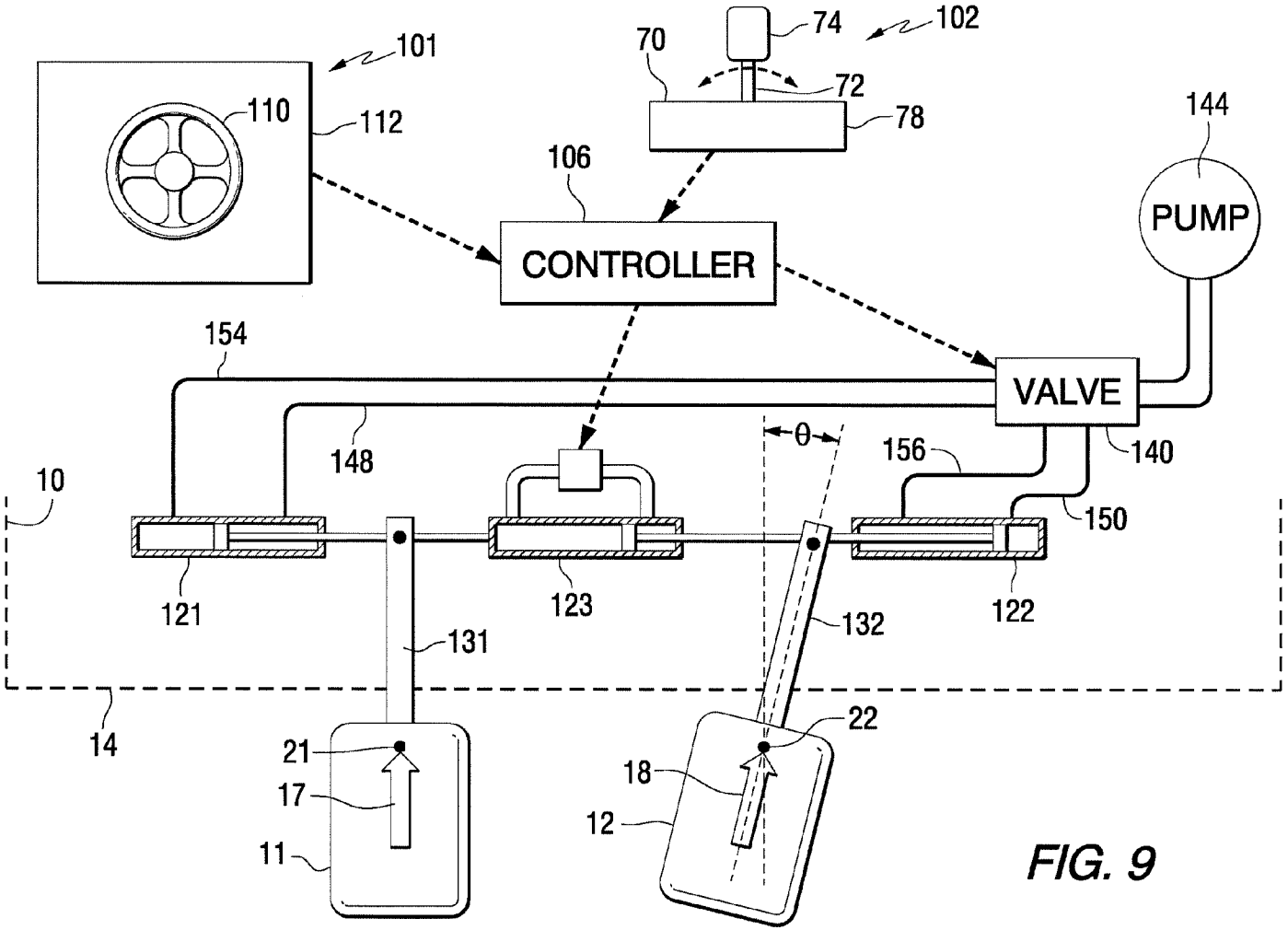

FIG. 9 shows the configuration similar to FIGS. 7 and 8, but with the second marine propulsion device 12 rotated in an opposite direction than illustrated in FIG. 8. The movement shown in FIG. 9 would be accomplished by the controller 106 controlling the valve 140 to cause a flow of pressurized hydraulic fluid to flow through conduit 156 and return from the second steering actuator 122 through conduit 150. The valve 140 would be controlled to prevent flow through conduits 148 and 154 in order to lock the first steering arm 131 in place as described above.

When the operator of the marine vessel is controlling the boat with the joystick during maneuvering procedures, the thrusts, 17 and 18, provided by the two marine propulsion devices are controlled, along with the gear selection of both devices, in the manner described in U.S. Pat. No. 4,220,111 or 4,947,782. Control of the thrust vectors, 17 and 18, can also be performed in the manner described in U.S. Pat. No. 6,234,853 or 6,994,046. Since the techniques used to control the direction and magnitude of the thrusts provided by marine propulsion devices are well known to those skilled in the art and described above in several United States patents, those techniques will not be described in detail herein. Typically, systems of that type use a digital throttle and shift (DTS) system in which a microprocessor transmits control signals to a controller within each marine propulsion device.

It should be understood that, in a preferred embodiment of the present invention, all maneuvering motions are achieved through the movement of only the second marine propulsion device 12 with the first marine propulsion device 11 locked in a forward position as illustrated in FIGS. 8 and 9. Although the present invention allows various alternative operations, the capability of the preferred embodiment shown in FIGS. 8 and 9 is illustrated in the table of FIG. 10.

With continued reference to FIG. 9, an alternative embodiment of the present invention could eliminate the first steering actuator 121 (i.e. the one illustrated on the port side), connect the valve 140 to the third steering actuator 123 (i.e. the one in the center), and use the second steering actuator 122 (i.e. the actuator at the starboard position) as a "locked" actuator during docking maneuvers. The steering would then be achieved through the use of the third steering actuator 123, in response to a joystick, while the locked actuator 122 would prevent the steering wheel from moving during the docking procedure.

With reference to FIG. 10, twenty-seven examples of joystick positions are shown in combination with the resulting thrust magnitude for the port and starboard marine propulsion devices, 11 and 12, and the magnitude of angle θ illustrated in FIGS. 8 and 9. It should be understood that the magnitudes in the table of FIG. 10 are exemplary and selected solely to show that numerous combinations of magnitudes, both positive and negative, can be achieved and satisfied through the sole movement of the second marine propulsion device 12. The exemplary numbers in the table of FIG. 10 do not represent specific units (e.g. pounds or foot-pounds), but are used to show the ability of the system to satisfy the various commands received from the joystick. As described above in conjunction with FIGS. 6A-6C, the handle 74 of the joystick can be moved forward, backward, to the left, to the right, and rotated to convey the desire of the marine vessel operator to the controller 106. Naturally, a maximum movement in any direction would represent some associated maximum analogous level of thrust in that direction or some maximum moment of rotation. In the table of FIG. 10, Example 1 represents a movement of the joystick handle 74 toward the right to request a thrust of 10 units (e.g. pounds), a movement forward to request a forward thrust of 10 units and a rotation of the handle 74 to represent a request of 10 units (e.g. foot-pounds) moment. As shown in the table, the controller 106 would determine that a port thrust 17 of 41.667 units in a forward direction, a starboard thrust 18 of −33.208 units and an angle θ of −17.526 degrees for the second marine propulsion device 12 would result in the joystick request. The 27 examples in FIG. 10 show all of the possible combinations of 10, 0, and −10 for all three of the commands received from the joystick 70. In these hypothetical examples shown in the table, the X dimension for the joystick represents a left-right selection, the Y dimension represents a forward-reverse selection and the M dimension represents a rotation of the handle 70 about is central axis 86 as discussed above in conjunction with FIGS. 6B and 6C. The results illustrated in the table of FIG. 10 show that movement of the second marine propulsion device 12, with the first marine propulsion device 11 fixed in a forward direction, allows the controller 106 to achieve all of the commanded movements selected by the operator of the marine vessel.

With continued reference to FIGS. 1-4, 5A-5E, 6A-6C, and 7-10, it can be seen that a preferred embodiment of the present invention provides for a method for controlling the movement of a marine vessel which comprises the steps of attaching a first sterndrive unit 11 to the marine vessel 10 for rotation about a first steering axis 21, attaching a second sterndrive unit 12 to the marine vessel 10 for rotation about a second steering axis 22, connecting a first steering actuator 121 to the first sterndrive unit 11, connecting a second steering actuator 122 to the second sterndrive unit 12, connecting a third steering actuator 123 between the first and second sterndrive units, 11 and 12, with the third steering actuator 123 being selectively configurable in a first state wherein the first and second sterndrive units, 11 and 12, are rigidly attached together for synchronous rotation about their respective steering axes, 21 and 22, and a second state wherein the first and second sterndrive units are movable relative to each other, providing a steering wheel 110 which is configured to receive vessel movement commands from an operator of the marine vessel, providing a joystick 70 which is configured to receive vessel maneuver commands from the operator of the marine vessel, providing a controller 106 connected in signal communication with the steering wheel 110 and the joystick 70, receiving a set of vessel maneuver commands (e.g. X, Y, and M in FIG. 10) from the joystick 70, calculating a first thrust magnitude (e.g. thrust port in FIG. 10) for the first sterndrive unit 11, calculating a second thrust magnitude (e.g. thrust starboard in FIG. 10) for the second sterndrive unit 12, and calculating an angular position (e.g. theta in FIG. 10) of the second sterndrive unit 12 which will achieve a maneuver of the marine vessel 10 which accomplishes the vessel maneuver commands, causing the second sterndrive unit 10 to move to the angular position θ, causing the first drive sterndrive unit 11 to generate the first thrust magnitude 17, and causing the second sterndrive unit 12 to generate the second thrust magnitude 18.

With continued reference to all of the figures, a preferred embodiment of the present invention can further comprise the steps of using the first and second steering actuators, 121 and 122, to respond to the vessel movement commands. In addition, it can further comprise the step of causing the first sterndrive unit 11 to move to a fixed position, as illustrated in FIG. 8, wherein the fixed position disposes a propeller shaft of the first sterndrive unit 11 in parallel association with a central axis 32 of the marine vessel 10 extending from a transom 14 to a bow 36 of the marine vessel 10. In a preferred embodiment of the present invention, the vessel maneuver commands comprise a left-right command, a forward-reverse command, and a rotate command.

Although the present invention has been described with particularly specificity and illustrated to show a preferred embodiment, it should be understood that alternative embodiments are also within its scope.

We claim:

1. A method for controlling the movement of a marine vessel, comprising the steps of:

attaching a first marine propulsion device to said marine vessel for rotation about a first steering axis;

attaching a second marine propulsion device to said marine vessel for rotation about a second steering axis;

connecting a first steering actuator to said first marine propulsion device;

connecting a second steering actuator to said second marine propulsion device;

providing a first manually manipulatable control device which is configured to receive vessel movement commands from an operator of said marine vessel;

providing a second manually manipulatable control device which is configured to receive vessel maneuver commands from said operator of said marine vessel;

providing a controller connected in signal communication with said first and second manually manipulatable control devices;

receiving a set of vessel maneuver commands from said second manually manipulatable control device;

calculating a first thrust magnitude for said first marine propulsion device, a second thrust magnitude for said second marine propulsion device, and an angular position of said second marine propulsion device which will achieve a maneuver of said marine vessel which accomplishes said vessel maneuver commands;

maintaining said first marine propulsion device in a position which disposes a propeller shaft of said first marine propulsion device in parallel association with a central axis of said marine vessel;

causing said second marine propulsion device to move to said angular position;

causing said first marine propulsion device to generate said first thrust magnitude; and causing said second marine propulsion device to generate said second thrust magnitude.

2. The method of claim 1, further comprising:

connecting a third steering actuator to said first and second marine propulsion devices.

3. The method of claim 2, wherein:

said third steering actuator is selectively configurable in a first state wherein said first and second marine propulsion devices are rigidly attached together for synchronous rotation about their respective steering axes and a second state wherein said first and second marine propulsion devices are movable relative to each other.

4. The method of claim 1, further comprising:

causing said first marine propulsion device to move to a fixed position.

5. The method of claim 4, wherein:

said fixed position disposes a propeller shaft of said first marine propulsion device in parallel association with a central axis of said marine vessel extending from a transom to a bow of said marine vessel.

6. The method of claim 1, further comprising:

using said first steering actuator to respond to said vessel movement commands; and using said second steering actuator to respond to said vessel maneuver commands.

7. The method of claim 1, wherein:

said first and second marine propulsion devices are sterndrive units which are attached to a transom of said marine vessel.

8. The method of claim 1, wherein:

said second manually manipulatable control device is a joystick.

9. The method of claim 1, wherein:

said controller comprises a microprocessor.

10. The method of claim 1, wherein:

said vessel maneuver commands comprise a left-right command, a forward-reverse command, and a rotate command.

11. A method for controlling the movement of a marine vessel, comprising the steps of:

attaching a first sterndrive unit to said marine vessel for rotation about a first steering axis;

attaching a second sterndrive unit to said marine vessel for rotation about a second steering axis;

connecting a first steering actuator to said first sterndrive unit;

connecting a second steering actuator to said second sterndrive unit;

connecting a third steering actuator between said first and second sterndrive units, said third steering actuator being selectively configurable in a first state wherein said first and second sterndrive units are rigidly attached together for synchronous rotation about their respective steering axes and a second state wherein said first and second sterndrive units are movable relative to each other;

providing a first manually manipulatable control device which is configured to receive vessel movement commands from an operator of said marine vessel;

providing a second manually manipulatable control device which is configured to receive vessel maneuver commands from said operator of said marine vessel;

providing a controller connected in signal communication with said first and second manually manipulatable control devices;

receiving a set of vessel maneuver commands from said second manually manipulatable control device;

calculating a first thrust magnitude for said first sterndrive unit, a second thrust magnitude for said second sterndrive unit, and an angular position of said second sterndrive unit which will achieve a maneuver of said marine vessel which accomplishes said vessel maneuver commands;

causing said second sterndrive unit to move to said angular position;

causing said first sterndrive unit to generate said first thrust magnitude; and causing said second sterndrive unit to generate said second thrust magnitude.

12. The method of claim 11, further comprising:

using said first steering actuator to respond to said vessel movement commands; and using said second steering actuator to respond to said vessel maneuver commands.

13. The method of claim 11, wherein:

said first manually manipulatable control device is a steering wheel; and said second manually manipulatable control device is a joystick.

14. The method of claim 11, further comprising:

causing said first sterndrive unit to move to a fixed position, said fixed position disposing a propeller shaft of said first sterndrive unit in parallel association with a central axis of said marine vessel extending from a transom to a bow of said marine vessel.

15. The method of claim 11, wherein:

said vessel maneuver commands comprise a left-right command, a forward-reverse command, and a rotate command.

16. A method for controlling the movement of a marine vessel, comprising the steps of:

attaching a first sterndrive unit to said marine vessel for rotation about a first steering axis;

attaching a second sterndrive unit to said marine vessel for rotation about a second steering axis;

connecting a first hydraulic actuator to said first sterndrive unit;

connecting a second hydraulic actuator to said second sterndrive unit;

connecting a third hydraulic actuator between said first and second sterndrive units, said third hydraulic actuator being selectively configurable in a first state wherein said first and second sterndrive units are rigidly attached together for synchronous rotation about their respective steering axes and a second state wherein said first and second sterndrive units are movable relative to each other;

providing a steering wheel which is configured to receive vessel movement commands from an operator of said marine vessel;

providing a joystick which is configured to receive vessel maneuver commands from said operator of said marine vessel;

providing a controller connected in signal communication with said steering wheel and joystick;

receiving a set of vessel maneuver commands from said joystick;

calculating a first thrust magnitude for said first sterndrive unit, a second thrust magnitude for said second sterndrive unit, and an angular position of said second sterndrive unit which will achieve a maneuver of said marine vessel which accomplishes said vessel maneuver commands;

causing said second sterndrive unit to move to said angular position;

causing said first sterndrive unit to generate said first thrust magnitude; and causing said second sterndrive unit to generate said second thrust magnitude.

17. The method of claim 16, further comprising:

using said first hydraulic actuator to respond to said vessel movement commands; and using said second hydraulic actuator to respond to said vessel maneuver commands.

18. The method of claim 16, further comprising:

causing said first sterndrive unit to move to a fixed position, said fixed position disposing a propeller shaft of said first sterndrive unit in parallel association with a central axis of said marine vessel extending from a transom to a bow of said marine vessel.

19. The method of claim 16, wherein:

said vessel maneuver commands comprise a left-right command, a forward-reverse command, and a rotate command.

* * * * *